US007021959B2

(12) United States Patent
Tsuji et al.

(10) Patent No.: US 7,021,959 B2
(45) Date of Patent: Apr. 4, 2006

(54) WIRE COVER WITH TWO LONGITUDINAL HALVES CONNECTABLE AROUND ELECTRIC WIRES

(75) Inventors: Takeshi Tsuji, Yokkaichi (JP); Toshifumi Ichio, Yokkaichi (JP); Michiaki Okamoto, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 10/719,324

(22) Filed: Nov. 20, 2003

(65) Prior Publication Data

US 2004/0102082 A1 May 27, 2004

(30) Foreign Application Priority Data

Nov. 22, 2002 (JP) ..... 2002-339567
Jan. 10, 2003 (JP) ..... 2003-004817

(51) Int. Cl.
*H01R 13/58* (2006.01)

(52) U.S. Cl. ..... 439/470; 439/731
(58) Field of Classification Search ..... 439/445, 439/452, 456, 459, 465, 467, 470, 731, 471
See application file for complete search history.

(56) References Cited

U.S. PATENT DOCUMENTS 4,108,527 A * 8/1978 Douty et al. ..... 439/465
4,749,369 A * 6/1988 Wang ..... 439/459
5,391,092 A * 2/1995 Sumida ..... 439/470
5,422,437 A * 6/1995 Schnell ..... 174/65 R
5,586,916 A * 12/1996 Shinji et al. ..... 439/467
5,980,327 A 11/1999 Yen ..... 439/470

FOREIGN PATENT DOCUMENTS

JP 10-27645 1/1998
JP 11-089046 3/1999

* cited by examiner

*Primary Examiner*—James R. Harvey
(74) *Attorney, Agent, or Firm*—Gerald E. Hespos; Anthony J. Casella

(57) ABSTRACT

A cover (20) has opposed halves (21) with butting walls (28). An engaging projection (27) is formed in an accommodation concavity (30) rearward from an edge (29) of the butting wall (28). A portion between the engaging projection (27) and the edge (29A) on a bottom surface of the accommodation concavity (30) defines a temporary holding surface (32) which is contacted by a connection portion (26B) of a locking arm (26) on the opposed half (21). The temporary holding surface (32) stabilizes the posture of each half (21) before the locking arm (26) rides over the engaging projection (27). Thus, halves (21) do not incline and the connection operation is accomplished smoothly.

2 Claims, 18 Drawing Sheets

WIRE COVER WITH TWO LONGITUDINAL HALVES CONNECTABLE AROUND ELECTRIC WIRES

BACKGROUND OF THE INVENTION

1. Field of the Invention

The invention relates to a connector with a cover to protect electric wires extended from a connector housing.

2. Description of the Related Art

Japanese Patent Application Laid-Open No. 10-27645 and FIGS. 16–18 herein disclose a connector with a cover for protecting electric wires that extend from a connector housing. The cover is formed as two longitudinal halves of a rectangular tube.

An engaging portion and a receiving portion are formed on each of the upper and lower butting walls that are butted against each other when the halves of the cover are connected. The engaging portions on opposed edges are disposed obliquely, and the receiving portions on the opposed edges also are disposed obliquely. The line that connects the engaging portions to each other crosses the line that connects the receiving portions to each other. Additionally the engaging portions of one half align with the receiving portions of the other half.

The two halves of the cover are reversed with respect to their axes, and the respective halves of the cover are mounted laterally on the rear end of the housing. As a result, the engaging portion of one half rides across the receiving portion of the other half and is locked to the receiving portion. Thus both halves are fit on each other, and the halves form a tubular cover mounted on the housing.

The end of the cover remote from the housing has an irregular holding portion that fits on the periphery of a corrugate tube and holds the corrugate tube unremovably. The electric wires extend from the corrugate tube and are inserted into the cavities of the housing through the path formed inside the cover.

The halves of the cover shown in Japanese Patent Application Laid-Open No. 10-27645 are intended to approach each other linearly after the engaging portion and the receiving portion butt against each other. The engaging portion should deform elastically in an expansion direction and should ride over the receiving portion. The engaging portion then should return elastically to its original state and lock to the receiving portion.

However, as shown in FIGS. 16 and 17, the halves 101 may have an inclined posture when a pressing force is applied to the halves 101. As a result, both halves 101 butt against each other, and the engaging portion 102 may deform and ride obliquely over the receiving portion 103. However, the engaging portion 102 and the receiving portion 103 are not locked together. More particularly, each receiving portion 103 faces the butting edge of the opposed half 101. Thus, in connecting the halves 101 to each other, the posture of each of the halves 101 becomes unstable because the engaging portion 102 rides over the receiving portion 103 without engagement. Thus the engaging portion 102 is not subject to a high resistance accompanied by elastic deformation. Rather, the engaging portion 102 is subject only to a low resistance with no elastic deformation. Accordingly, the halves 101 are liable to be easily connected to each other in an inclined posture.

FIG. 18 shows a portion of the inside of the cover 100 where the electric wires W extend from an edge 112*a* of a corrugate tube 112. The electric wires W are introduced into the housing through the inner path of the cover 100 and contact the inner periphery of the corrugate tube 112. Sharply pointed burrs project from the edge 112*a* of the corrugate tube 112 due to a molding or cutting operation. The electric wires W are subjected to sliding contact with the edge 112*a* of the corrugate tube 112 due to shaking caused by vibrations of a traveling vehicle. As a result, there is a possibility that insulating coatings of the electric wires W will be damaged.

The invention has been made in view of the above-described problems.

Accordingly, an object of the invention is to provide a cover that facilitates connecting both halves of the cover together.

It is another object of the invention to prevent damage to electric wires by holding the electric wires in a cover without contact between extended portions of the electric wires and an edge of the corrugate tube.

SUMMARY OF THE INVENTION

The invention relates to a connector with a housing and wires that extend from a rear end of the housing. A cover is mounted on a rear end of the housing to surround the wires. The cover has two opposed halves that preferably are connected by butting edges of one half against edges of the other half.

At least one engaging projection is formed on each butting wall and the engaging projections on the respective butting walls are offset obliquely with respect to one another. At least one locking piece also is formed on each butting wall. The locking pieces are offset obliquely with respect to one another, but align with the engaging projections on the opposite butting wall. Each locking piece rides across the corresponding engaging projection and locks with the corresponding engaging projection to prevent the halves from separating.

The engaging projections are slightly rearward from the edge of the butting wall along the connecting direction. Thus, a portion of an outer surface of the butting wall between the edge of the butting wall and the engaging projection defines a temporary holding surface that supports the locking piece before the locking piece reaches the engaging projection during the connection of the halves. Consequently, the halves are held in a normal posture. The temporary holding surface of the butting wall stabilizes the posture of each of the halves in an initial stage of the connecting operation and before the locking piece rides over the engaging projection. Thus, unlike the prior art, it is possible to prevent the halves from being connected in an inclined posture and the connection can be accomplished smoothly.

A guide preferably is formed on the butting wall for guiding the locking piece in the direction in which the halves are connected. The guide prevents the locking piece from deviating in the front-to-back direction on the upper surface of the butting wall. Accordingly, the halves will not be connected in an inclined posture and the connection can be accomplished smoothly.

An accommodation concavity preferably is formed on an outer surface of the butting wall and opens toward the edge of the butting wall. The locking projection is formed in the accommodation concavity. The locking piece is formed on a level that allows the locking piece to slide on an inner surface of the accommodation concavity while the halves are being connected together. Additionally, the locking piece can fit in the accommodation concavity after the two halves are connected. Thus, the locking piece and the accommodation concavity overlap in a thickness direction of the butting wall. Therefore, the outer dimension of the cover is reduced.

The guide preferably is integral with the accommodation concavity. Thus, the guide cooperates with the inner sidewall of the accommodation concavity, and the construction of the connector is simplified.

The cover may include a lock on an inner peripheral surface of an end of the cover at a side from which electric wires extend. The lock preferably engages a periphery of the corrugate tube to allow the corrugate tube to be mounted unremovably on the cover. An electric wire guide preferably is adjacent the lock and defines a diameter of a path for the electric wires extended from the corrugate tube that is smaller than an inner diameter of an edge of the corrugate tube. Thus, the electric wires do not have a sliding contact with the edge of the corrugate tube even if the wires are shaken, and the insulating coating of the wires cannot be damaged.

The electric wire guide preferably includes half annular projections formed circumferentially on an inner surface of each half of the cover. Thus, an end of the corrugate tube is inserted into one of the half covers. The electric wires then are positioned on the inner periphery of the half projection, and the half covers are fixed together by a locking mechanism. Accordingly, the corrugate tube and the electric wires can be mounted easily. The path for the electric wires is regulated by the inner periphery of the annular projection, and the electric wires will not be cut by the periphery of the cover.

The electric wire guide preferably includes a contact portion with a smooth rounded surface for contacting the electric wires W. Thus, the contact portion of the electric wire guide will not adversely affect the insulating coating of the electric wires.

DETAILED DESCRIPTION OF THE PREFERRED EMBODIMENTS

Figure 1:
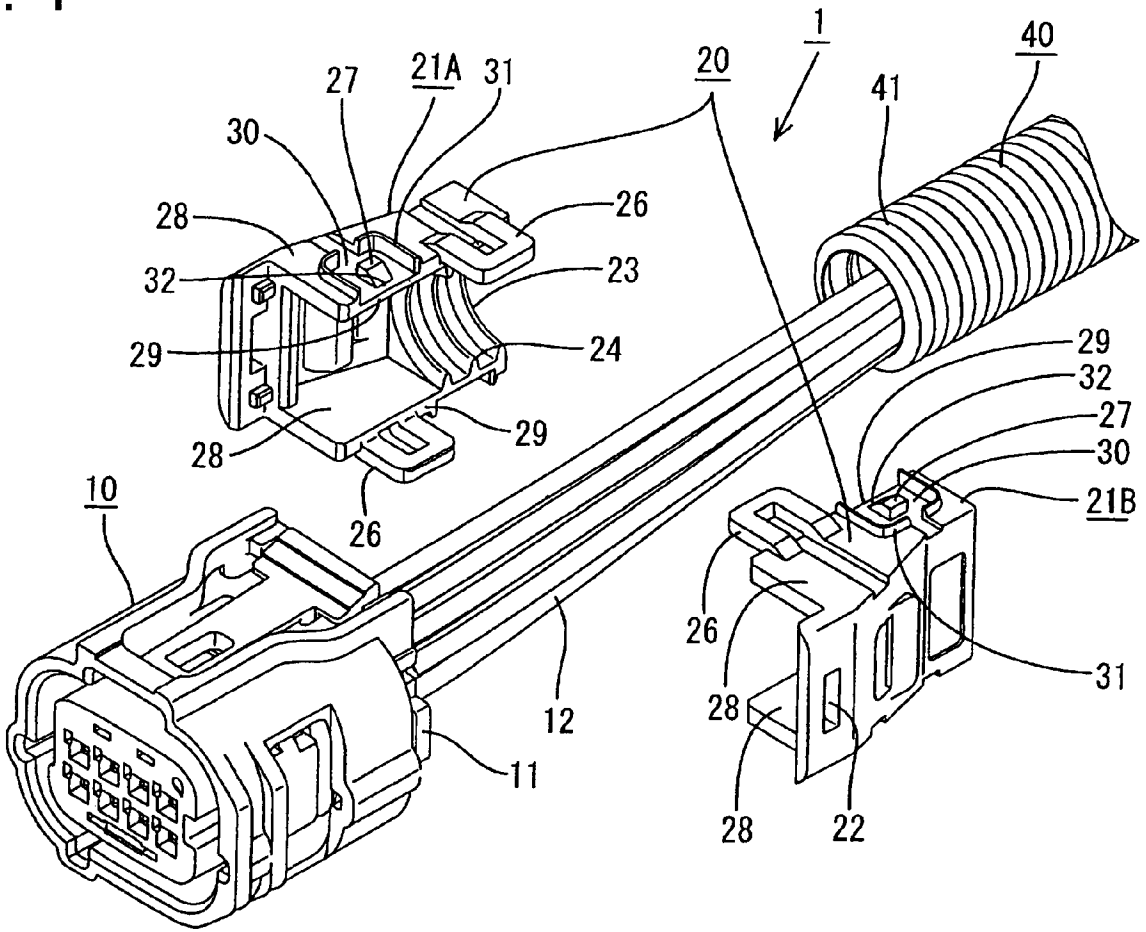
FIG. 1 is an exploded perspective view showing a connector of an embodiment of the present invention.
Figure 2:
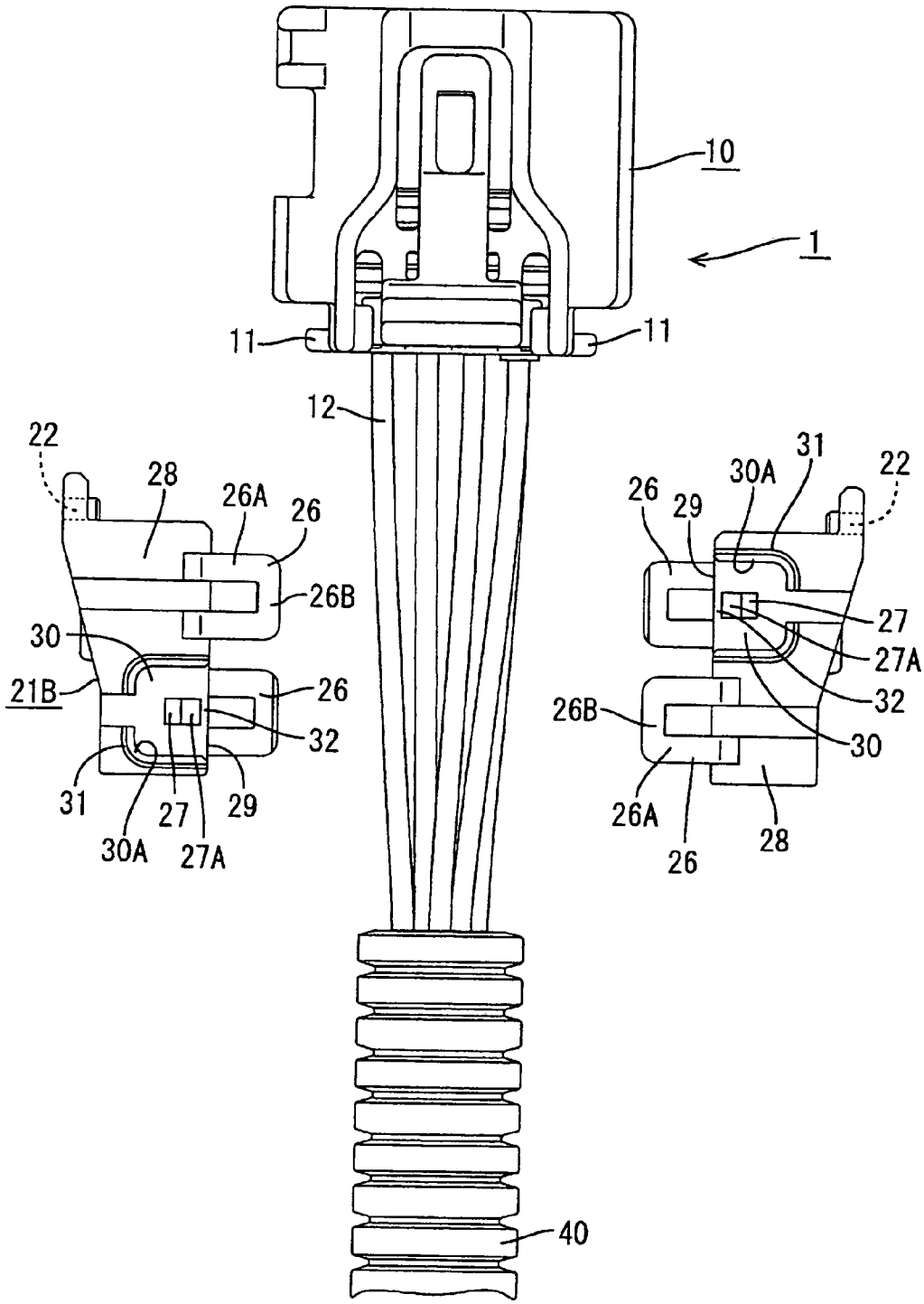
FIG. 2 is a plan view showing the connector before halves of a cover connect to each other.
Figure 3:
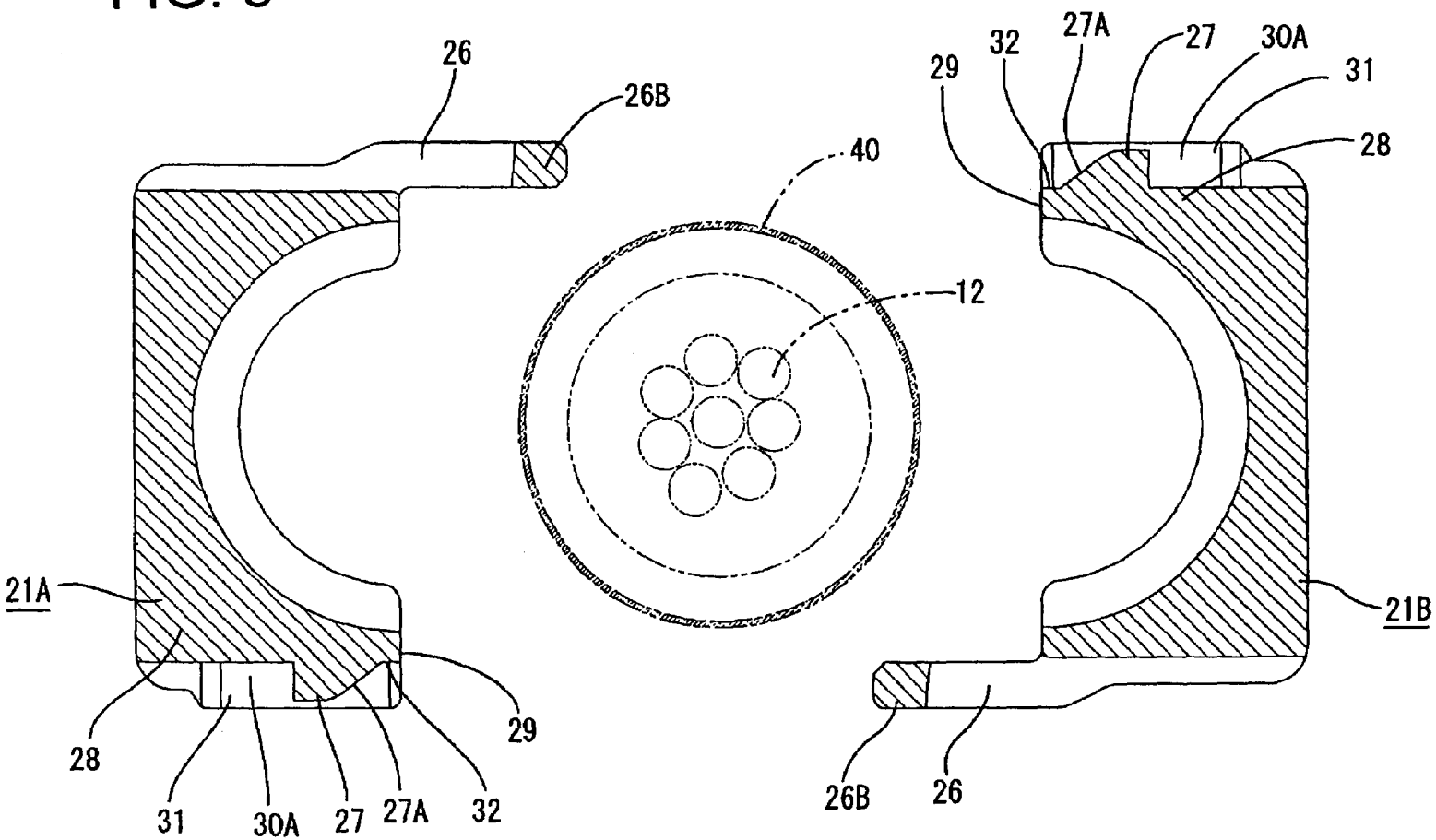
FIG. 3 is a sectional view showing the cover before the halves of the cover are connected to each other.
Figure 4:
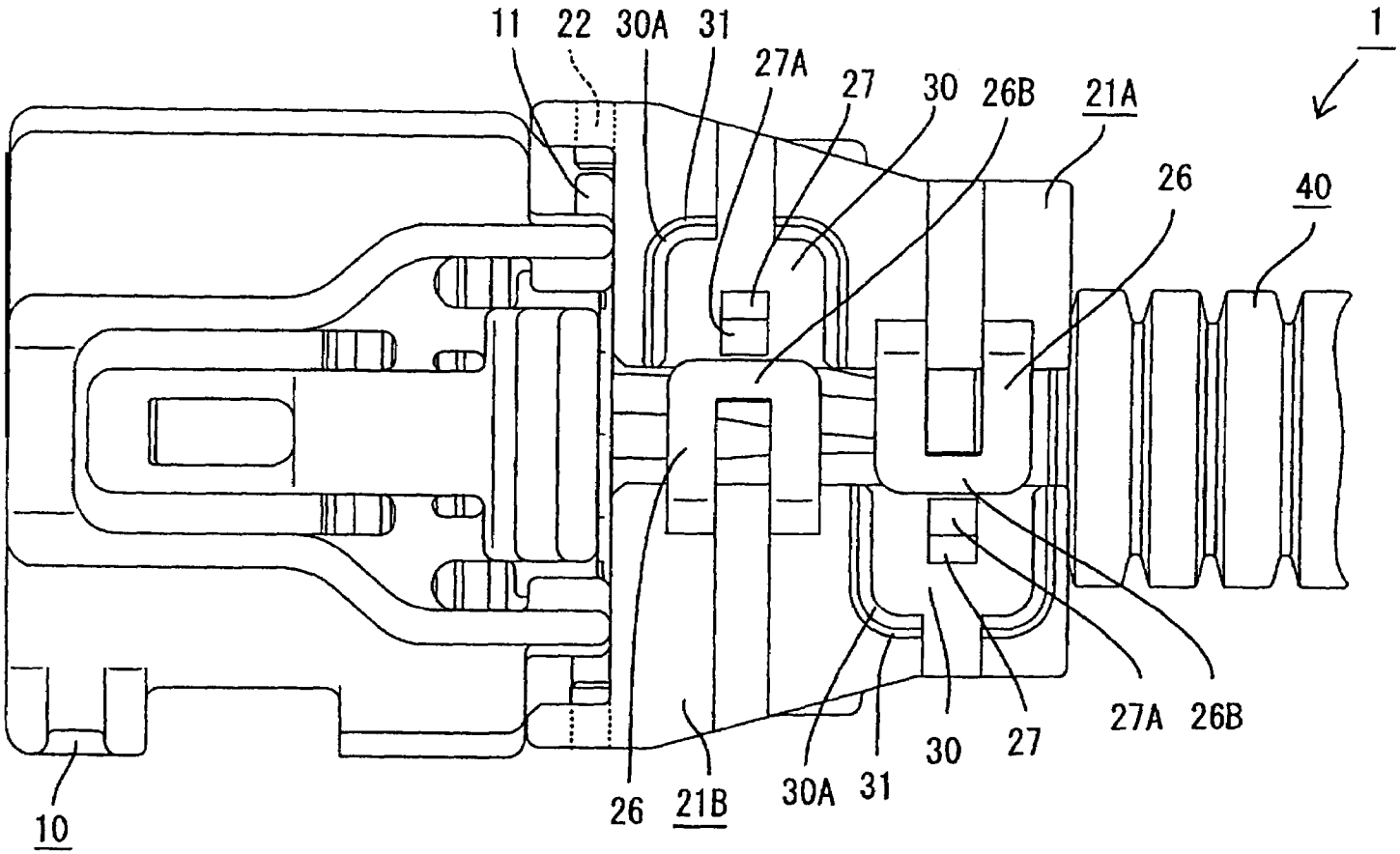
FIG. 4 is a plan view showing the connector while the halves of the cover are being connected to each other.
Figure 5:
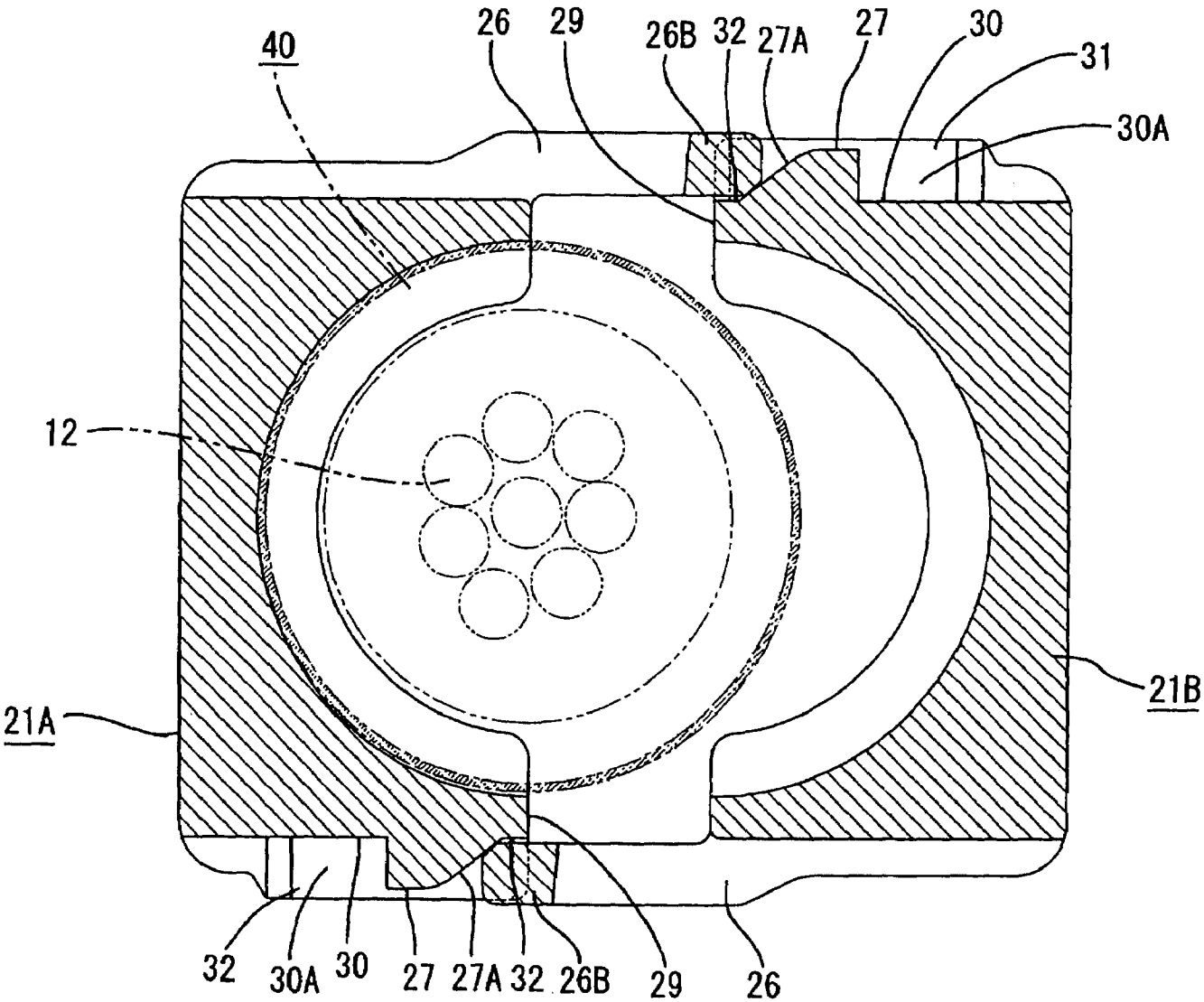
FIG. 5 is a sectional view showing the cover while the halves of the cover are being connected to each other.

A connector according to the invention is identified generally by the numeral 1 in FIGS. 1 through 9. The connector 1 includes a housing 10 that accommodates terminal fittings (not shown) connected to electric wires 12 and a cover 20. The cover 20 is constituted of two halves 21A and 21B and is mounted on the housing 10 (see FIGS. 1 through 3). In the following description, the direction in which the electric wires 12 are extended from the connector housing 10 is defined as the front-to-back direction. The direction in which the halves 21A and 21B are connected to each other is defined as the right-to-left direction. The direction crossing the above two directions (i.e. the direction crossing the paper on which FIG. 2 is shown) is defined as the vertical direction.

The wires 12 connected to the terminal fittings extend from a rear end of the housing 10. Mounting projections 11 for mounting the cover 20 on the connector housing 10 are formed at right and left sides of a rear end of the housing 10.

The wires 12 that extend from the housing 10 are inserted in a corrugate tube 40 to protect the wires 12 without exposure to the outside.

The cover 20 is approximately a rectangular tube that is open in the front-to-back direction to surround and protect a portion of the wires 12 extended from the housing 10. The cover 20 has two longitudinal halves 21A and 21B configured as if the cover 20 was divided along its axis. The halves 21A and 21B have the same configuration and are connected to each other by axially reversing them.

A mounting hole 22 penetrates a front portion of each half 21A, 21B for receiving the mounting projections 11 of the housing 10. The cover 20 can be installed on the housing 10 by fitting the mounting projections 11 in the mounting holes 22.

A semicircular cutout 23 is formed at a rear surface of each half 21A, 21B for receiving the corrugate tube 40. The cutouts 23 of the halves 21A and 21B are coincident with each other when the halves 21A and 21B are connected so that the corrugate tube 40 can be inserted therein. Locking plates 24 are formed circumferentially at regular intervals on the inner peripheral surface of each half 21A, 21B close to the cutout 23 and fit in grooves 41 of the corrugate tube 40. The locking plates 24 lock the corrugate tube 40 axially by fitting in the groove 41. Thus, axial movement of the corrugate tube 40 with respect to the cover 20 is prevented.

Upper and lower locking arms 26 and upper and lower engaging projections 27 are formed on each half 21A and 21B. More particularly, one locking arm 26 and one engaging projection 27 are disposed on an upper buffing wall 28 and the other locking arm 26 and the other engaging projection 27 are disposed on a lower butting wall 28. The butting walls 28 are butted together when halves 21A and 21B are connected together. The two engaging projections 27 of each of the half 21A and 21B are disposed obliquely with respect to one another. The two locking arms 26 of each half 21A and 21B also are disposed obliquely with respect to one another. A line connecting the engaging projections 27 to each other crosses a line connecting the locking arms 26 to each other. Additionally, the locking arm 26 of one half 21A, 21B aligns with the engaging projection 27 of the other half 21A, 21B. That is, the locking arms 26 of the half 21A in FIG. 1 are toward the rear end of the upper buffing wall 28 and toward the front end of the lower butting wall 28. Conversely, the engaging projections 27 are close to the front end of the upper butting wall 28 and the rear end of the lower buffing wall 28.

The locking arm 26 extends from an edge 29 of the butting wall 28 of the half 21 in a direction in which the halves 21A and 21B are connected together. Each locking arm 26 has spaced apart arm portions 26A and a connection portion 26B that connects the arm portions 26A to each other at a projected end of each arm portion 26A. Thus the locking arm 26 has a U-shape, and is capable of accommodating the engaging projection 27 of the mating half 21A, 21B therein.

An accommodation concavity 30 is formed concavely at a position aligned with the locking arm 26 of the mating half 21A, 21B and is dimensioned to accommodate the locking arm 26. Additionally, the accommodation concavity 30 is open at the side of the edge 29 to allow the locking arm 26 to advance therein. The upper end of the locking arm 26 is lower than the upper end of the edge 29. Thus, the locking arm 26 slides in contact with a bottom surface of the accommodation concavity 30 as the halves 21A and 21B are connected.

Generally L-shaped guide walls 31 align with and extend continuously from the inner surfaces 30A of the accommodation concavity 30. The guide walls 31 have legs that extend parallel to the direction of advance of the locking arm 26 and rear end legs that extend along a rear end surface of the accommodation concavity 30. The guide walls 31 and the inner side surfaces 30A function to guide the locking arm 26 into the accommodation concavity 30.

The engaging projection 27 is formed on the bottom surface of the accommodation concavity 30 at a position slightly rearward from the edge 29 in the direction in which the halves 21A and 21B are connected. A portion between the engaging projection 27 and the edge 29A on the bottom surface of the accommodation concavity 30 defines a temporary holding surface 32 that is contacted by the connection portion 26B of the locking arm 26. The engaging projection 27 has an inclined surface 27A at the side of the edge 29. The inclined surface 27A inclines down toward the front to allow the locking arm 26 to ride smoothly thereon.

The cover 20 is mounted on the housing 10 by axially reversing the halves 21A and 21B and then laterally fitting the halves 21A and 21B on the rear end of the housing 10. At this time, the mounting projection 11 of the housing 10 is fit temporarily in the mounting hole 22 of the half 21A, and the locking plate 24 of the half 21A is fit temporarily in the groove 41 of the corrugate tube 40.

The halves 21A and 21B then are fit together and on both the housing 10 and the corrugate tube 40. More specifically, the locking arms 26 of each half 21A and 21B are advanced into the accommodation concavities 30. Thus, the halves 21A and 21B are fit lightly on each other while the tips of the connection portion 26B of each locking arm 26 is held on the temporary holding surface 32 of the accommodation concavity 30 of the mating halves 21A and 21B. The halves 21A and 21B are held in a normal fit-on posture (see FIGS. 4 and 5) because the connection portions 26B of the respective locking arms 26 contact the respective temporary holding surfaces 32 in this state.

Figure 6:
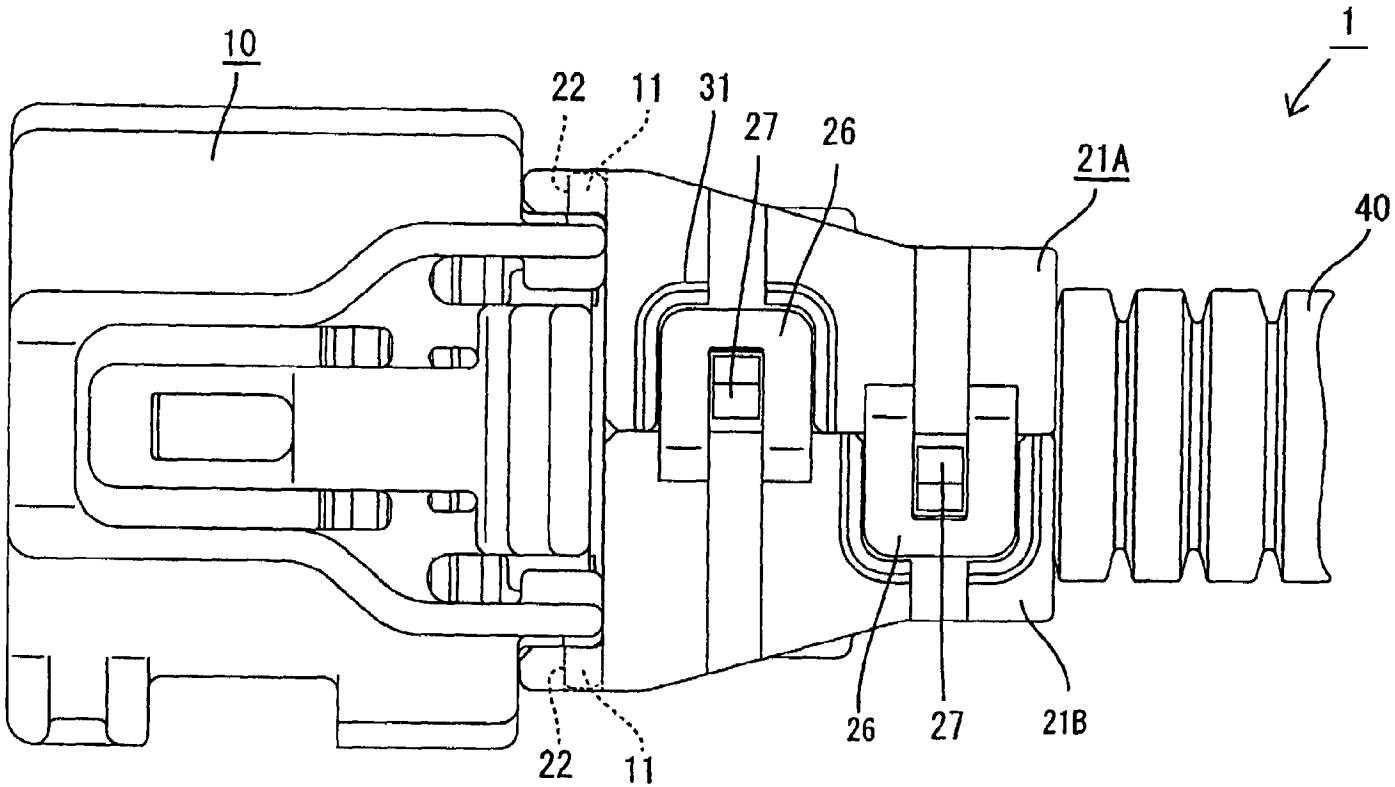
FIG. 6 is a plan view showing the connector after the halves of the cover are connected to each other.
Figure 7:
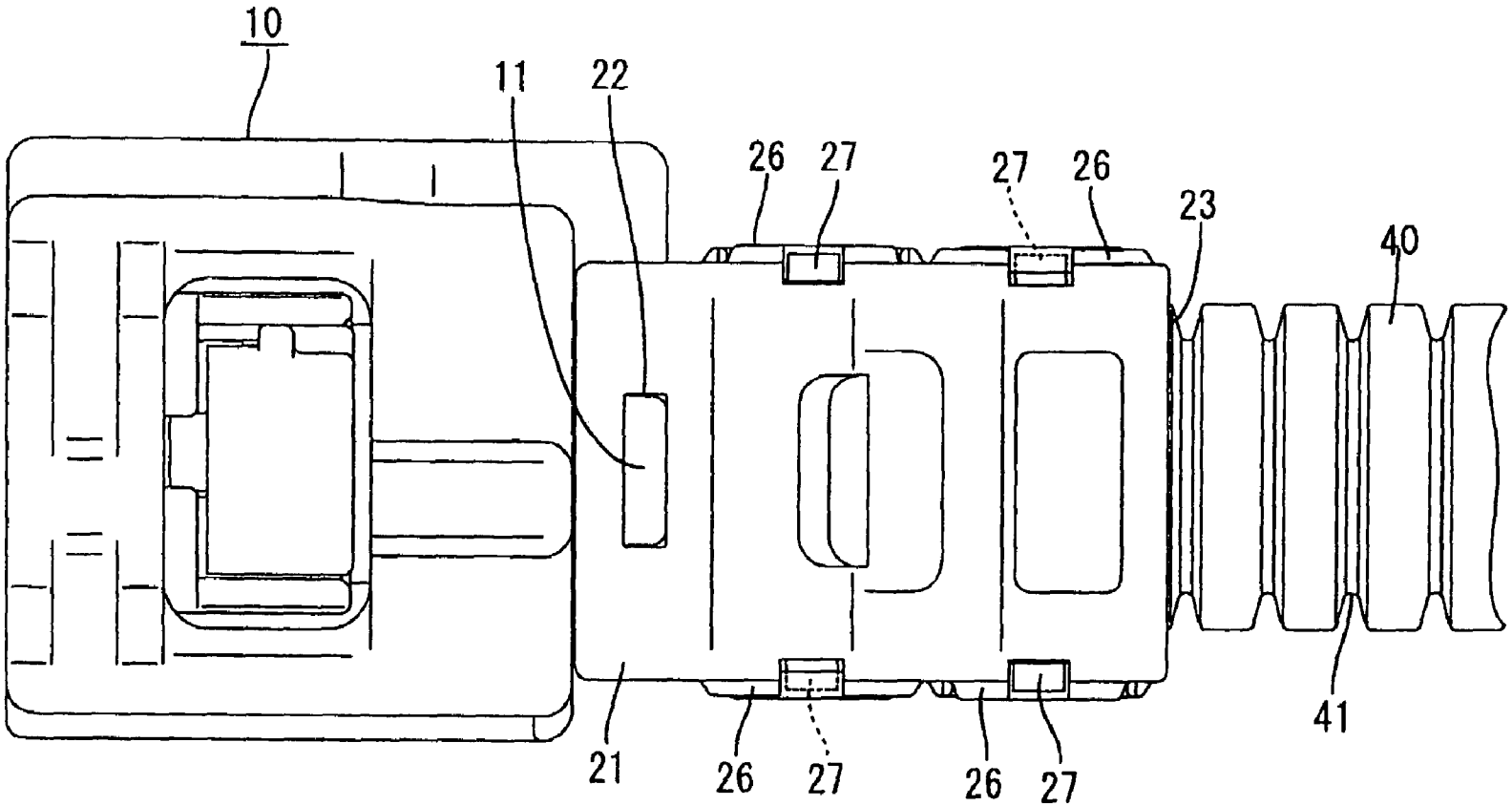
FIG. 7 is a side view showing the connector after the halves of the cover are connected to each other.
Figure 8:
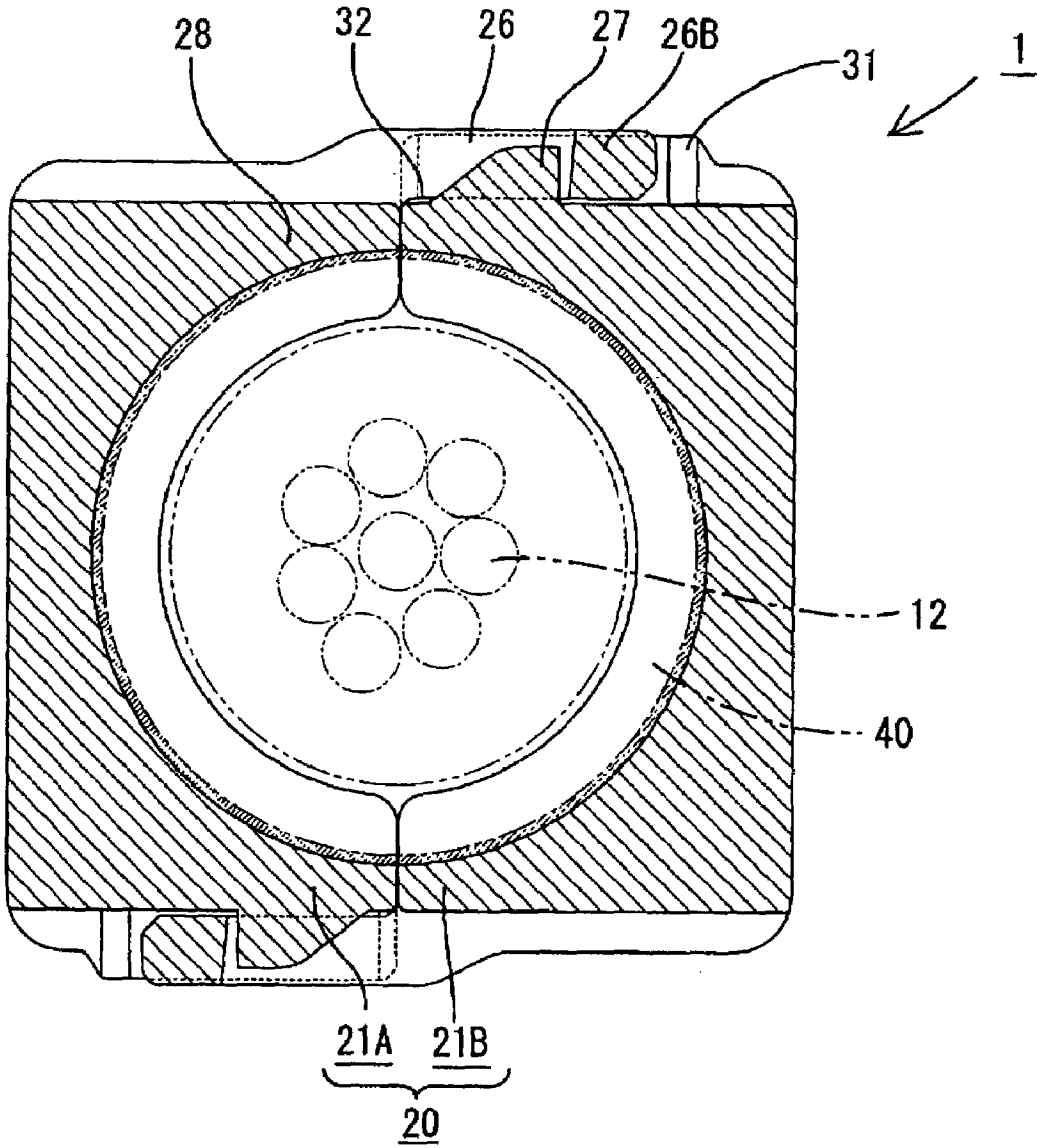
FIG. 8 is a sectional view showing the cover after the halves of the cover are connected to each other.
Figure 9:
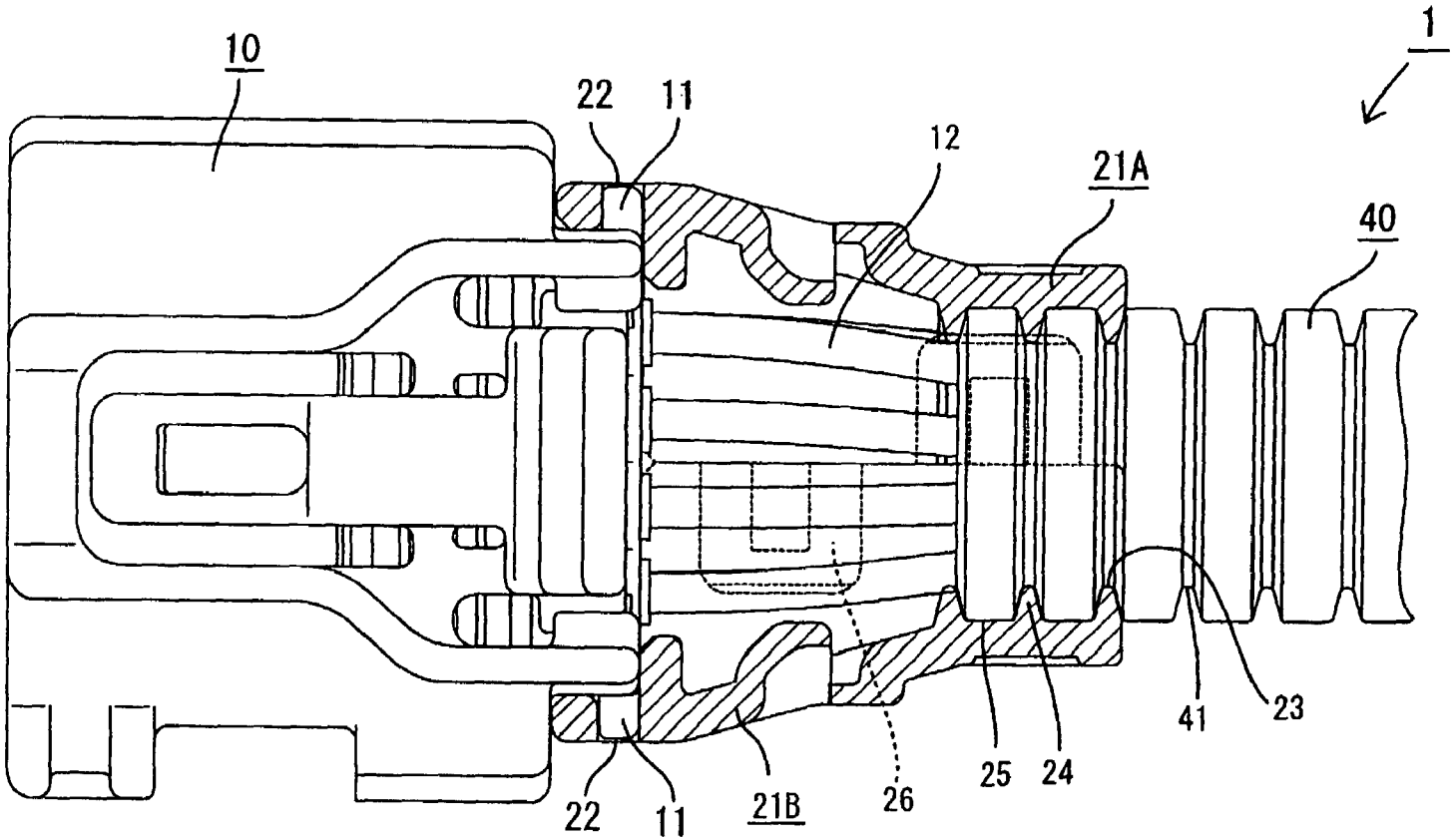
FIG. 9 is a side sectional view showing the cover after the halves of the cover are connected to each other.

The half 21B then is pressed toward the mating half 21A, so that both halves 21A and 21B are fit together (see FIGS. 6 and 8). At this time, the locking arm 26 is guided straight into the accommodation concavity 30 by the inner sidewall 30A of the accommodation concavity 30 and the guide wall 31. Thus, the locking arm 26 does not deviate in the front-to-back direction.

The half 21B is pressed further so that the connection portion 26B of each half 21A and 21B rides over the inclined surface 27A of the engaging projection 27. As a result, the locking arm 26 is flexed in an expansion direction. The half 21B then is pressed sufficiently for the connection portion 26B of the locking arm 26 to ride across the engaging projection 27. As a result, the locking arm 26 returns elastically to its original state and locks to the engaging projection 27. Thus, the halves 21A and 21B are held inseparably together. The locking arm 26 contacts the temporary holding surface 32 of the butting wall 28 to stabilize the posture of each half 21A and 21B before the locking arm 26 rides over the engaging projection 27. Thus, the halves 21A and 21B are not connected to each other in an inclined posture and the connection is accomplished smoothly.

The locking arm 26 is fit in the accommodation concavity 30 when the halves 21A and 21B are connected properly together. At the same time, the mounting projection 11 of the housing 10 is fit in the mounting hole 22 of each half 21A and 21B, and the locking plate 24 is fit in the groove 41 of the corrugate tube 40. Thus, the halves 21A and 21B are connected together, and the cover 20 is mounted on the rear end of the housing 10. At the same time, the corrugate tube 40 is installed on the cover 20 (see FIGS. 7 and 9). Thus, the mounting of the cover 20 on the housing 10 is completed.

As described above, the engaging projection 27 is in the accommodation concavity 30 on the butting wall 28 and slightly rearward from the edge 29. The temporary holding surface 32 is formed between the engaging projection 27 and the edge 29A on the bottom surface of the accommodation concavity 30 and is contacted by the connection portion 26B of the locking arm 26. Thus, the temporary holding surface 32 of the butting wall 28 stabilizes the posture of each half 21A and 21B before the locking arm 26 rides over the engaging projection 27 in an initial stage in the operation of connecting the halves 21A and 21B together. Thus, unlike the conventional art, the halves 21A and 21B cannot be connected in an inclined posture and the connection operation is accomplished smoothly.

The accommodation concavities 30 are formed concavely on the outer surface of the halves 21, and the locking arms 26 are on a level to slide on the bottom surface of the accommodation concavities 30. The locking arms 26 fit in the accommodation concavities 30 after both halves 21A and 21B are connected, and the thickness of the butting wall 28 overlaps the thickness of the locking arm 26 in the accommodation concavity 30. Therefore, the outer dimension of the cover 20 is small.

The accommodation concavity 30 has two guide walls 31 formed at the right and left edges thereof in the advance direction of the locking arm 26. The guide wall 31 is continuous with the right and left inner sidewalls 30A of the accommodation concavity 30. The guide wall 31 and the inner sidewall 30A function to guide the locking arm 26 during connection of the halves 21A and 21B. Accordingly, the locking arm 26 cannot deviate in the front-to-back direction on the upper surface of the butting wall 28, and the halves 21A and 21B cannot be connected in an inclined posture. Thus, the connection operation is accomplished smoothly.

Figure 10:
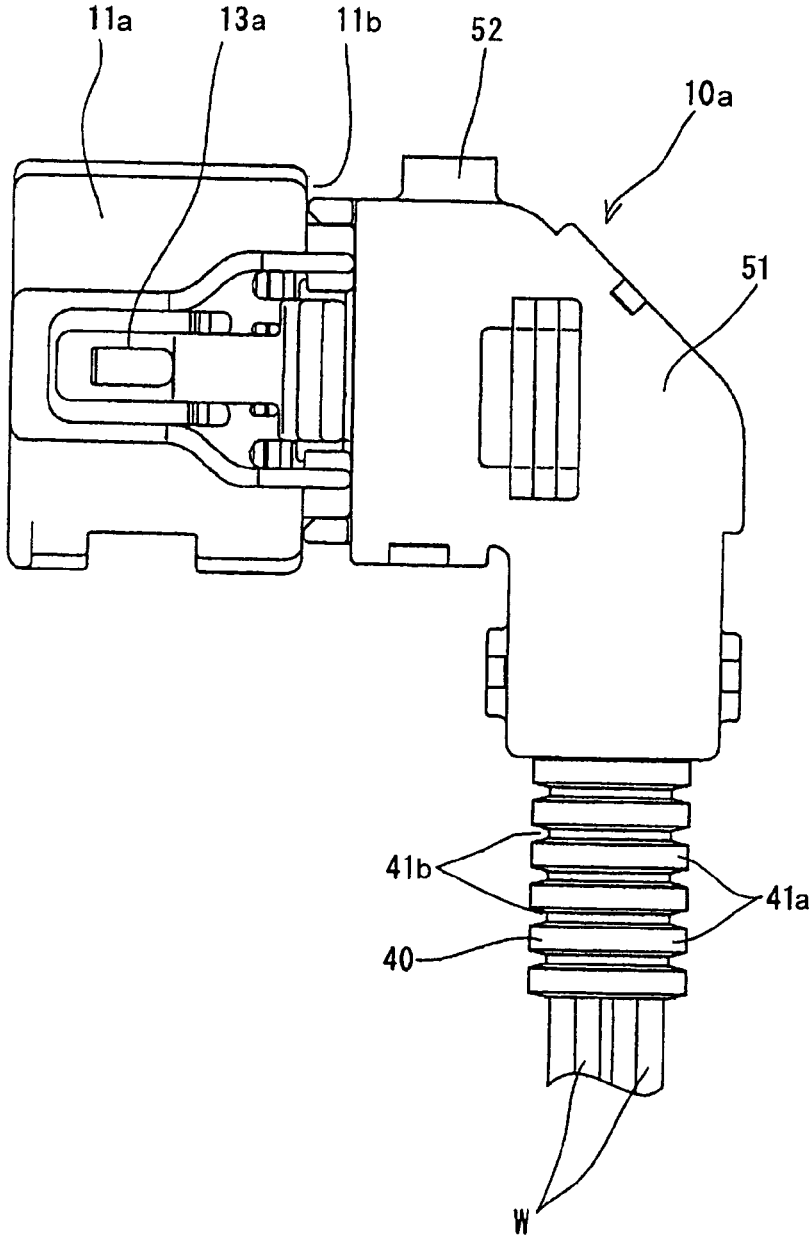
FIG. 10 is a plan view showing an alternate embodiment of a connector with a cover for a corrugate tube.

FIG. 10 shows an alternate embodiment of a connector 10*a* with a cover for a corrugate tube. The connector 10*a* has a housing 11 for receiving terminal fittings (not shown)

mounted on ends of electric wires W. A cover 51 covers the electric wires W extended from the housing 11 and holds an end of a corrugate tube 40 mounted on the periphery of the electric wires W.

Figure 11:
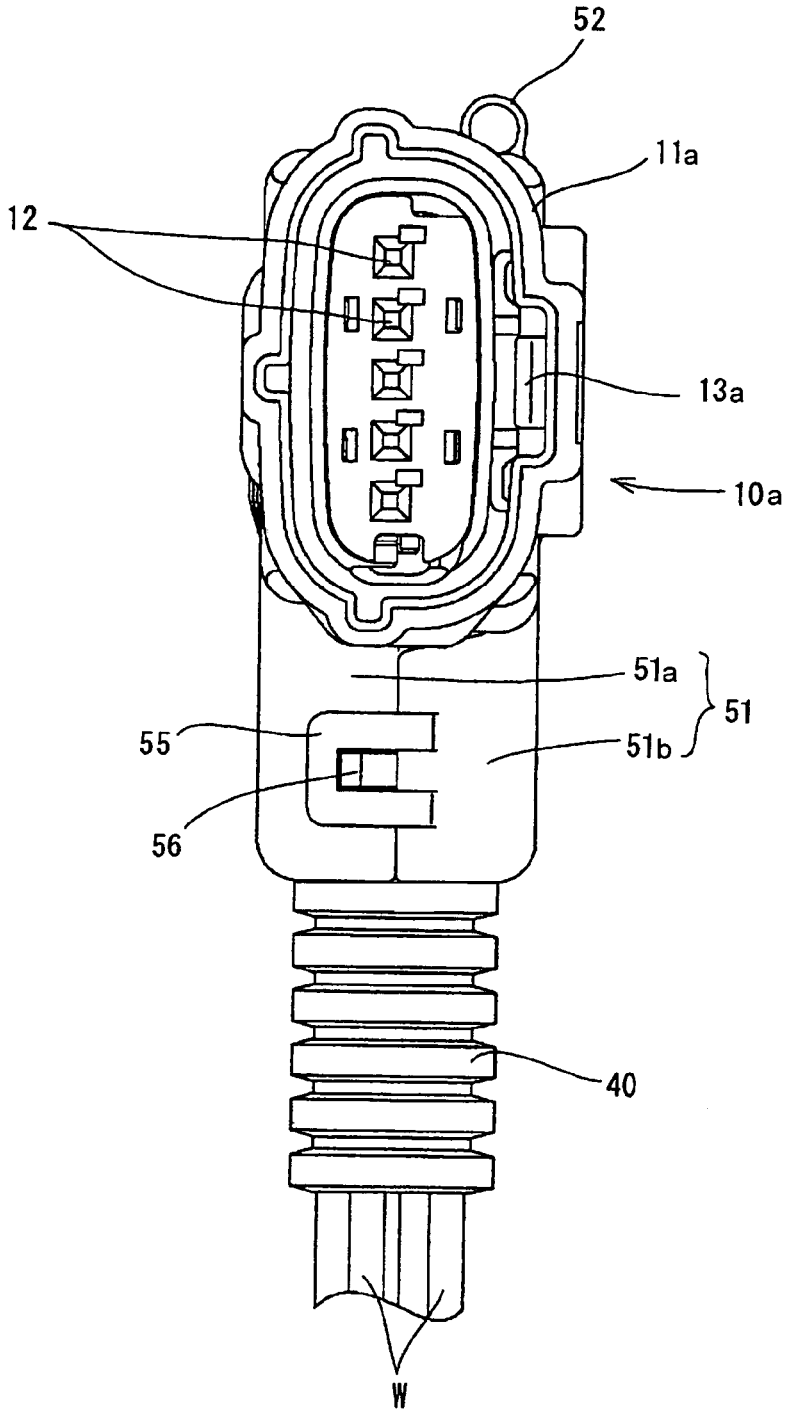
FIG. 11 is a left side view of the connector of FIG. 10.

The housing 11*a* is made of synthetic resin. As shown in FIG. 11, the housing 11*a* has five cavities 12 accommodating the terminal fittings respectively. A locking arm 13*a* for fixing the connector to a mating connector is formed on an outer surface of the housing 11*a*. A projection 14*a* on which an end of the cover 51 is mounted is formed on a terminal filling insertion surface 11*b* disposed on the rear of the housing 11*a* (see FIG. 13).

The corrugate tube 40 is made of synthetic resin and is elastic. The corrugate tube 40 protects bundled five electric wires W extended from the cavities 12*a* of the housing 11*a*. Convexities 41*a* and concave grooves 41*b* are formed alternately on the peripheral surface of the corrugate tube 40. An edge 42 held by the cover 51 is cut at an intermediate portion of the concave groove 41*b*.

Figure 12:
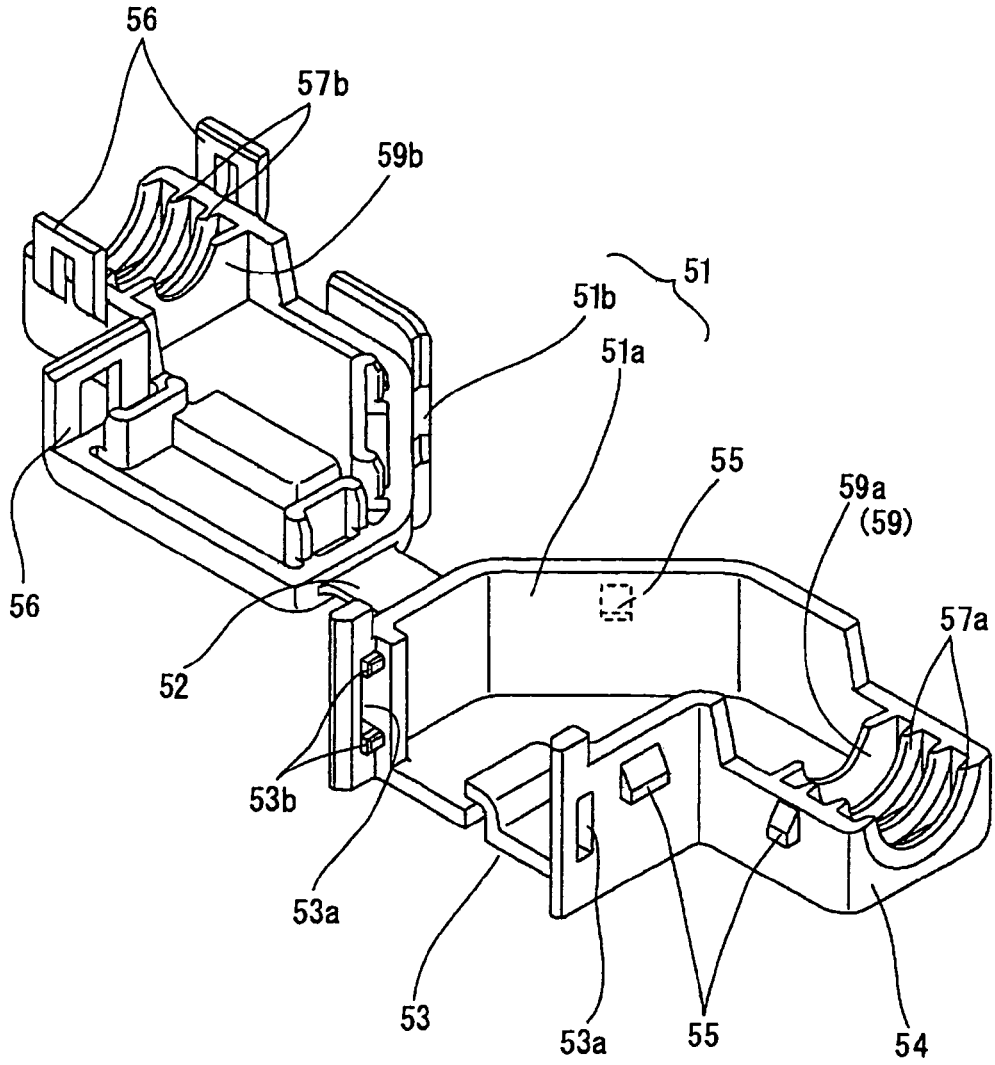
FIG. 12 is a perspective view showing the opened cover of FIGS. 10 and 11.

The cover 51 is L-shaped and made of synthetic resin. As shown in FIG. 12, the cover 51 has two half covers 51*a* and 51*b* that are connected to each other and can be opened and closed through a hinge 52 projected from one side of a housing-side end 53 that is to be mounted on the housing 11*a*. A locking mechanism is provided for fixing the half covers 51*a* and 51*b* in a closed condition. More particularly, locking claws 55 are provided at four positions of the half cover 51*a*, namely, a portion of a side wall at the housing end 53 opposite to a side wall on which the hinge 52 is formed, a portion of both side walls at a tube end 54 holding the corrugate tube 40, and a portion on an inclined wall intermediate between the hinge 52 and a electric wire guide 59. The other half cover 51*b* has locking frames 56 at positions corresponding to the positions of the locking claws 55. The locking frames 56 engage the respective locking claws 55 when the half covers 51*a* and 51*b* have been closed.

Fit-on grooves 53*a* are formed on inner surfaces of the housing ends 53 of the half cover 51*a* and fit on the projection 14*a* of the housing 11*a*. Looseness prevention projections 53*b* are formed at upper and lower positions of the fit-on grooves 53*a* and fit in concavities 14*b* at upper and lower positions of the projection 14*a*. A lock 57 is defined by three half locking projections 57*a* and 57*b* that project from inner peripheral surfaces of the tube end 34 of the cover 51*a* and from an inner peripheral surface of the tube end of the half cover 51*b* respectively. The half locking projections 57*a* and 57*b* engage the concave groove 41*b* of the corrugate tube 40 to unremovably install the end of the corrugate tube 40 on the cover 51.

Figure 13:
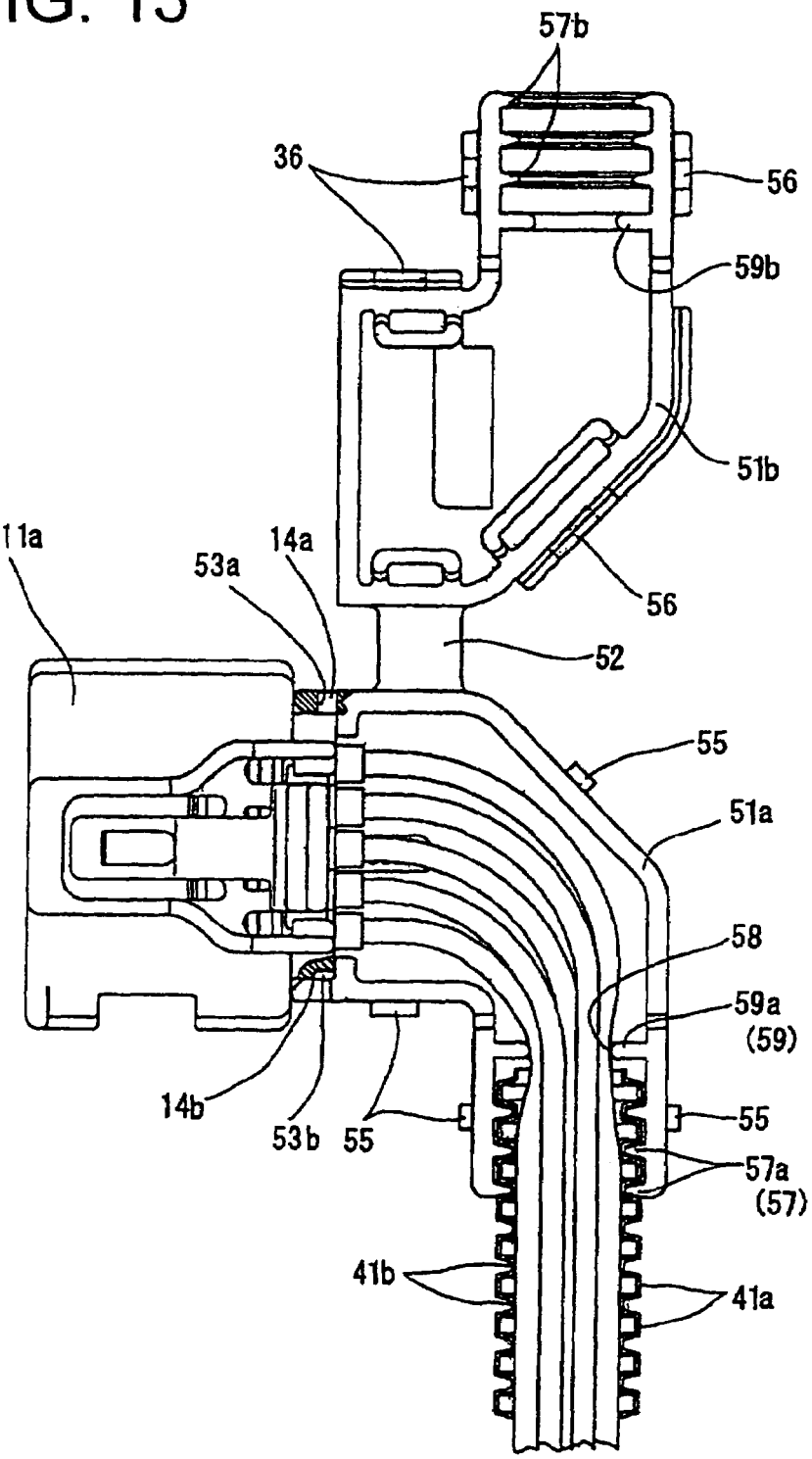
FIG. 13 is a plan view showing the opened cover of FIG. 12.
Figure 14:
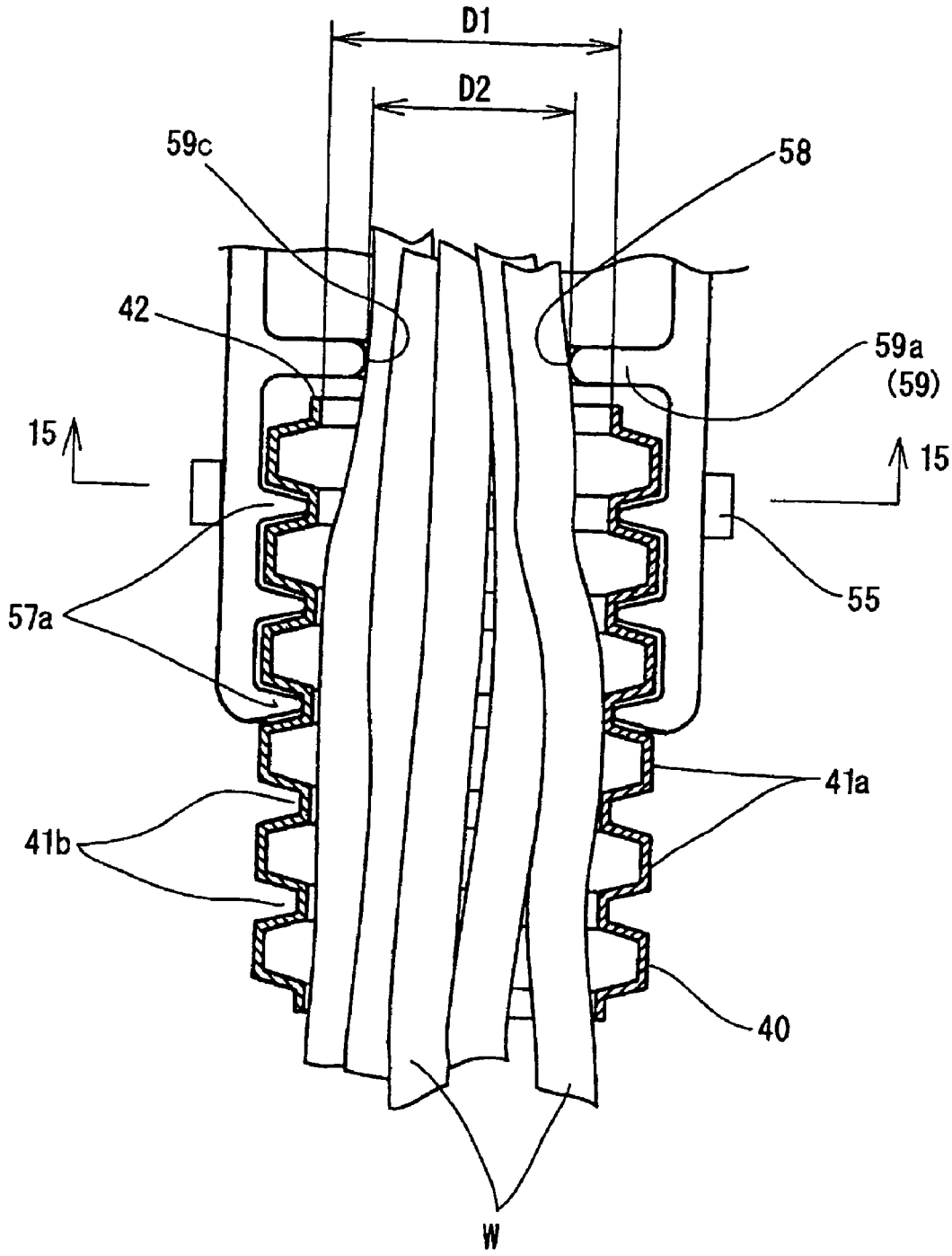
FIG. 14 is an enlarged view of the corrugate tube in the cover of FIGS. 10–13.
Figure 15:
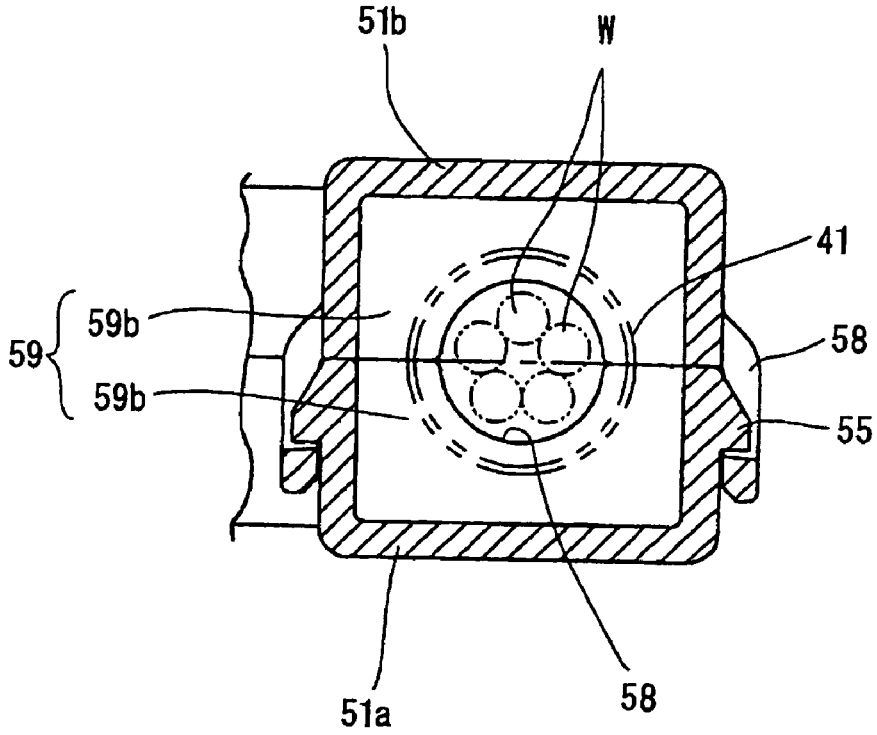
FIG. 15 is a sectional view taken along a line 15—15 of FIG. 14.
Figure 16:
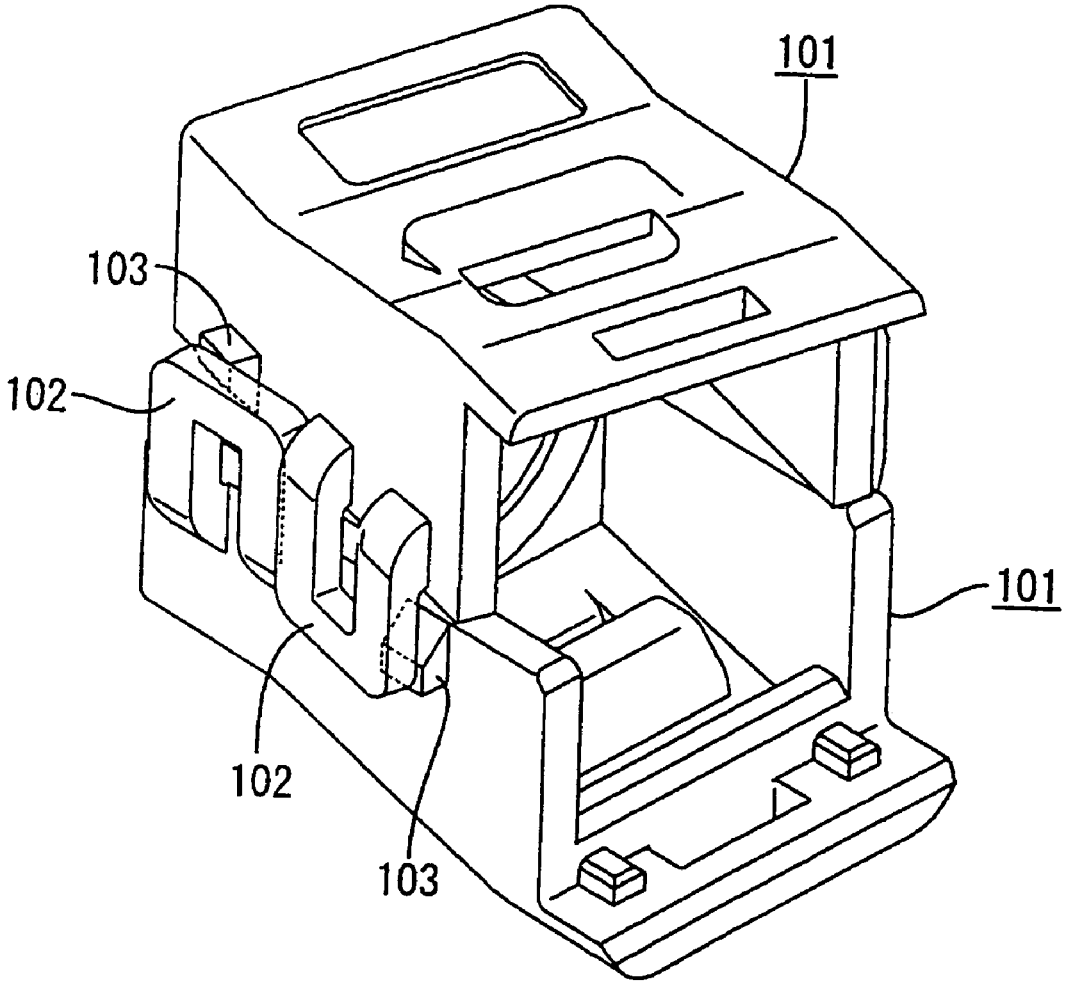
FIG. 16 (PRIOR ART)
FIG. 16 is a perspective view showing a cover of a conventional connector.
Figure 17:
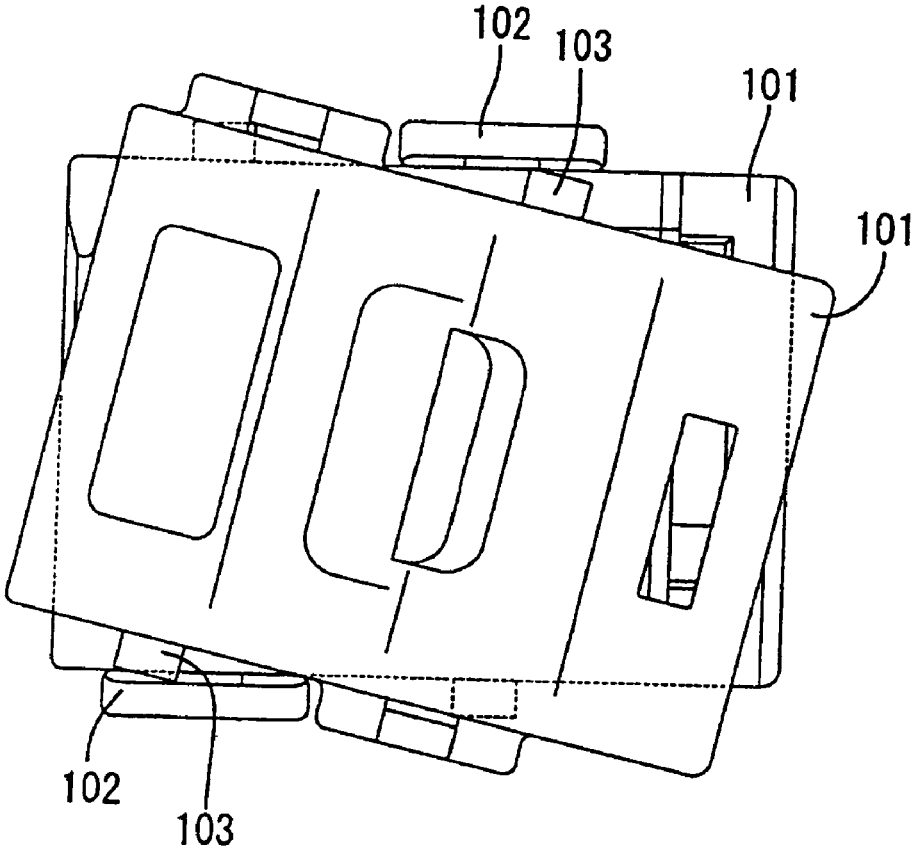
FIG. 17 (PRIOR ART)
FIG. 17 is a side view showing the cover of the conventional connector.
Figure 18:
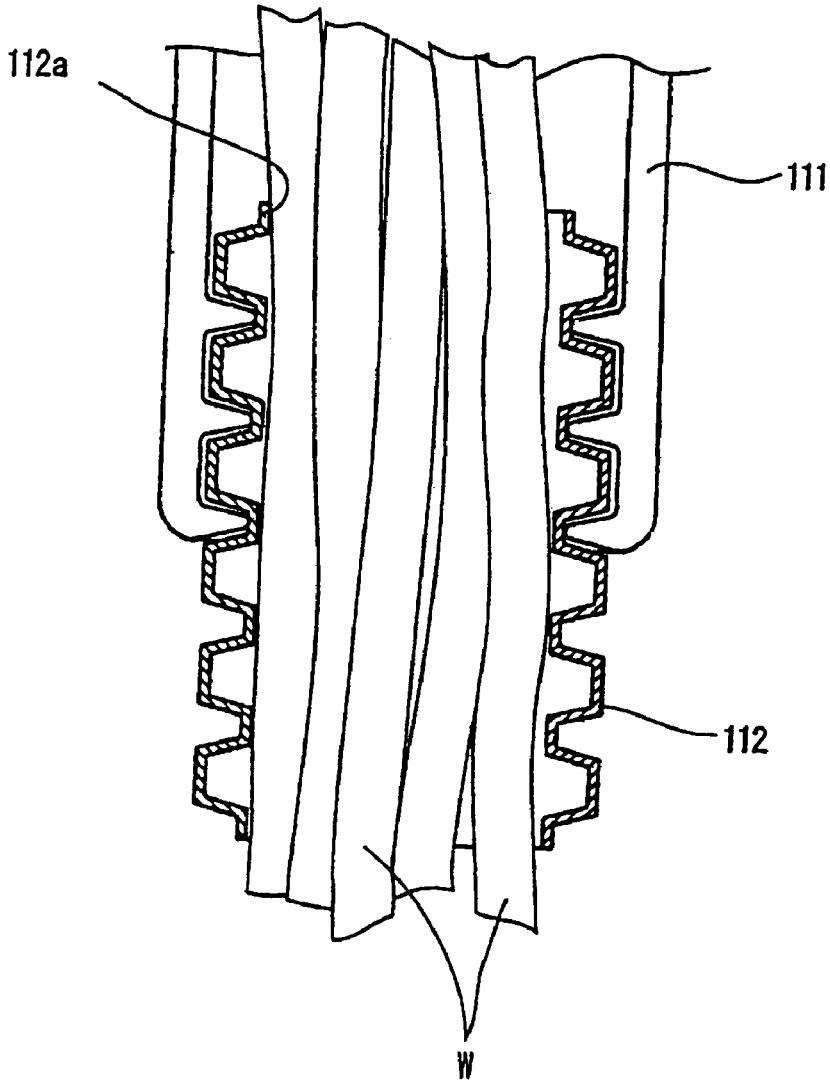
FIG. 18 (PRIOR ART)
FIG. 18 shows a cross-section of the prior art cover and the corrugate tube.

The electric wire guide 59 is formed at an inward position adjacent the locking portion 57, as shown in FIGS. 13 and 14, and regulates a path 58 of the electric wires W. The electric wire guide 59 has a smaller diameter than the inner diameter D1 of the edge 42 of the corrugate tube 40 mounted on the locking portion 57. The electric wire guide 59 is composed of half annular projections 59*a* and 59*b* formed circumferentially in integration with an inner peripheral wall of each of the half covers 51*a* and 51*b*. A portion surrounded with the half annular projections 59*a* and 59*b* defines the path 58 for the electric wires W. That is, the diameter D2 of the path 58 is smaller than the inner diameter D1 of the edge 42 of the corrugate tube 41. Thus, the electric wire guide 59 guides the electric wires W from the corrugate tube 41 into the cover 51 without contact between the electric wires W and the edge 42 of the corrugate tube 40. The section of a contact portion of the annular projections 59*a* and 59*b* defining the path 58 for the electric wires W is formed as a rounded surface 59*c*, as shown in FIG. 14 to prevent an insulating coating of the electric wires W from being damaged.

As shown in FIG. 13, the terminal fittings mounted at the ends of the five electric wires W on which the corrugate tube 40 has been mounted are inserted into the corresponding cavities 12*a* and locked thereto. The housing end 53 of the half cover 51*a* is engaged and held by the terminal fitting insertion surface 11*b* of the housing 11*a*. The edge 22 of the corrugate tube 40 is locked to the corresponding locking projection 57*a*. At this time, as shown in FIG. 14, the electric wires W extended from the edge of the corrugate tube 40 are disposed inside the path 58 of the annular projection 59*a* of the electric wire guide 59. Thereafter the half cover 51*b* is closed and connected to the half cover 51*a*, and the half covers 51*a* and 51*b* are fixed to each other in a closed state by the locking mechanism defined by the locking claws 55 and the locking frames 56.

The electric wires W extend from the edge 42 of the corrugate tube 40 and are guided through the cover 51 along the path 58 defined by the electric wire guide 59. The diameter D2 of the path 58 is smaller than the inner diameter D1 of the edge 42 of the corrugate tube 40. As a result, the electric wires W are disposed without contacting the edge 42 of the corrugate tube 40. Therefore, the electric wires W do not contact cut burrs at the edge 42 of the corrugate tube 40 even if vibrations of a traveling vehicle shake the electric wires W. Thus, the insulating coating of the electric wires W will not be damaged, because the electric wires W do not slide in contact with the edge 42 of the corrugate tube 40.

The invention is not limited to the embodiment described above with reference to the drawings. For example, the following embodiments are included in the technical scope of the present invention. Further, various modifications of the embodiments can be made without departing from the spirit and scope of the present invention.

The invention is applicable to a connector that does not use a corrugate tube.

The illustrated halves have the same configuration. However, the halves may have different configurations.

The locking arm and the engaging projection are formed on the peripheral surface of each half. However, the locking arm and the engaging projection do not have to be formed thereon. For example, the locking arm and the engaging projection may be on the inner peripheral surface of the half.

The guide wall 31 and the inner sidewall 30A of the accommodation concavity 30 serve as a means for guiding the locking arm 26. However, only the inner sidewall of the accommodation concavity may guide the locking arm. It is possible that the half does not have the accommodation concavity and that the guide wall is projected from the outer surface of the butting wall so that only the guide wall guides the locking piece.

In the second embodiment, the electric wire guide portion 59 is defined by the annular projections 59*a* and 59*b*. However, the path 58 may be quadrangular, provided that the cross-section D2 of the path 38 is smaller than the inner cross-section D1 of the edge 42 of the corrugate tube 40.

It is possible to reduce the diameter of the path 38 surrounded with the inner periphery of the annular projections 59*a* and 59*b* by making the side wall of the cover 51 thick.

Although the cover 51 is L-shaped and quadrangular in the second embodiment, the cover 51 may be straight or cylindrical.

Although the half covers 51*a* and 51*b* are connected to each other with the hinge 52 in second embodiment, they may be separate as in the first embodiment.

What is claimed is:

1. A connector comprising a housing accommodating electric wires extended from a rear end of the housing; and a cover mounted on the rear end of said housing (10) to surround said electric wires, said cover having two halves that are connected to each other by butting an edge of one buffing wall on one said half against an edge of a butting wall formed on said other half, at least one engaging projection on each said butting wall in each of said halves, and at least one locking piece on each butting wall in each of said halves at positions corresponding to positions of said engaging projections of the opposed half, said locking pieces being configured to ride across and lock to said corresponding engaging projection for preventing said halves from separating;

each of said engaging projections being formed on said butting wall at a position spaced inwardly from said edge of said butting wall in a direction in which said both halves are connected, whereby a portion of an outer surface of said butting wall between said edge of said butting wall and said engaging projection defines an outwardly open temporary holding surface that supports said locking piece before said locking piece reaches said engaging projection in connecting said halves to each other, thereby holding a connected posture of each of said halves in a normal posture, said outwardly open temporary holding surface permitting outward deflection of said locking piece so that said locking piece can ride across and lock to said corresponding engaging projection; and at least one guide formed on said butting wall outwardly from the respective engaging projection and at least partly surrounding portions of said engaging projections spaced from said edge of said butting wall so that an accommodation concavity is formed between said engaging projection and said guide, said locking piece being dimensioned to fit between the engaging projection and the guide, whereby the guide protects the locking piece from inadvertent contact.

2. The connector of claim 1, wherein said guide is formed integrally with said accommodation concavity.

* * * * *